US010794649B2

(12) United States Patent
Liu et al.

(10) Patent No.: US 10,794,649 B2
(45) Date of Patent: Oct. 6, 2020

(54) HANDGUNS

(71) Applicant: Comate Arms, LLC, Oriental, NC (US)

(72) Inventors: Dexter Liu, Oriental, NC (US); Bradley Michael Lang, Stella, NC (US)

(73) Assignee: COMATE ARMS, LLC, Oriental, NC (US)

( * ) Notice: Subject to any disclaimer, the term of this patent is extended or adjusted under 35 U.S.C. 154(b) by 0 days.

(21) Appl. No.: 16/605,613

(22) PCT Filed: Apr. 17, 2018

(86) PCT No.: PCT/US2018/027853
§ 371 (c)(1),
(2) Date: Oct. 16, 2019

(87) PCT Pub. No.: WO2018/195005
PCT Pub. Date: Oct. 25, 2018

(65) Prior Publication Data

US 2020/0132406 A1 Apr. 30, 2020

Related U.S. Application Data

(60) Provisional application No. 62/487,278, filed on Apr. 19, 2017.

(51) Int. Cl.
*F41A 19/22* (2006.01)
*F41A 9/28* (2006.01)
*F41C 3/16* (2006.01)

(52) U.S. Cl.
CPC ..... *F41A 19/22* (2013.01); *F41A 9/28* (2013.01); *F41C 3/16* (2013.01)

(58) Field of Classification Search
CPC ..... F41A 19/22; F41C 3/10
USPC ..... 42/59, 65; 89/1.41
See application file for complete search history.

(56) References Cited

U.S. PATENT DOCUMENTS

| | | | | |
|---|---|---|---|---|
| 191,178 A | | 5/1877 | Richardson | |
| 467,558 A | * | 1/1892 | Von Pecker | F41A 9/28 42/59 |
| 943,819 A | * | 12/1909 | Du Bose | F41C 3/14 42/59 |
| 990,669 A | | 4/1911 | Rodehaver | |
| 1,042,145 A | | 10/1912 | Rodehaver | |
| 3,170,261 A | * | 2/1965 | Ludovici | F41A 19/22 42/59 |

OTHER PUBLICATIONS

Slowik, Max, "The Pistola Con Caricato: 18-Shot Revolver, 3 Shots at a Time", May 10, 2012, pp. 1-3, retrieved on Jun. 6, 2018, retrieved from internet: <URL: http://www.guns.com/2012/05/10/pistola-con-caricato-18-shot-revolver/>.

* cited by examiner

*Primary Examiner* — Reginald S Tillman, Jr.
(74) *Attorney, Agent, or Firm* — Coats & Bennett, PLLC

(57) ABSTRACT

A handgun that can be configured to different firing settings. The settings provide for selectively firing a single round or two or more rounds. The handgun can include a body with two or more barrels. The handgun can also include a cylinder with different chambers positioned into groups that align with the barrels. The handgun includes a switch that can be moved to configure the handgun between the different settings.

17 Claims, 14 Drawing Sheets

HANDGUNS

RELATED APPLICATION

This application claims the benefit of U.S. Provisional Application No. 62/487,278 filed Apr. 19, 2017, the disclosure of which is incorporated by reference herein in its entirety.

BACKGROUND

Handguns are a popular firearm owned by many different people. One of the reasons for their popularity is their applicability in a large number of different uses. One use is for self-defense. The overall size of a handgun is relatively small which allows for it to be carried on a person, in their bags, and stored in many places such as a night stand. Handguns can also be used for sport, such as target shooting.

Because of the different uses, it is advantageous for the handgun to be configurable for use in different settings. For example, during target practice it could be beneficial to fire a single round. This allows the user to concentrate on the shot, and then be able to determine the location of the shot and make any necessary adjustments prior to firing again. In a defensive situation, it could be beneficial to simultaneously fire multiple rounds. This would increase the chances of hitting the intended target. Further, there may not be time for the user to fire multiple rounds therefore the ability to hit their target with the first shot is imperative.

For a handgun that can be configured to different settings, it would be beneficial for the handgun to provide a straightforward manner of adjustment. This would ensure that the handgun is able to fire in the various different settings. Further, the user would have confidence of the setting and not inadvertently fire the handgun while in an unintended setting.

SUMMARY

The present application is directed to handguns that are selectively positionable to different configurations to fire different numbers of rounds. The handgun includes a cylinder with inner and outer chambers each sized to hold rounds. A movable firing block and firing pin provide for selectively and simultaneously firing rounds from one or more of the chambers.

One aspect is directed to a handgun that includes a body with a trigger and a grip with the body having at least one upper barrel and a lower barrel. A firing pin is mounted in the body and movable between different positions. A cylinder is movably mounted to the body and includes chambers aligned into an outer group that are positioned in proximity to an outer periphery of the cylinder and an inner group that are positioned radially inward from the outer group with each of the chambers sized to hold one round. The cylinder is rotatable relative to the body to indexing positions that each include at least one of the chambers of the outer group being aligned with the at least one upper barrel and one of the chambers of the inner group being aligned with the lower barrel. The firing pin is movable between the different positions to be positioned at at least one of the chambers of the inner and outer groups.

In one aspect, the firing pin is movable between a first position at at least one of the chambers of the outer group, the second position at one of the chambers of the inner group, and the third position at at least one of the chambers of the outer group and one of the chambers of the inner group.

The handgun can also include a block that is positioned in the body and includes the firing pin with the block being movable within the body to adjust a position of the firing pin relative to the cylinder.

The handgun can include the firing pin having a first member to fire rounds from the outer group of chambers and a second member to fire rounds from the inner group of chambers.

The handgun can include that the inner and outer groups include an equal number of chambers.

The handgun can include that the outer group includes twice as many of the chambers as the inner group.

The handgun can include that the first position includes the firing pin extending over two of the chambers of the outer group and the second position includes the firing pin extending over one of the chambers of the inner group.

The handgun can include that the body has two upper barrels and one lower barrel.

The handgun can include that the body further has a first section that is pivotally connected to a second section with the at least one upper barrel and the lower barrel being positioned with the first section and the trigger being positioned with the second section.

The handgun can also include a cap sized to extend over an end of the cylinder and having an extension that fits into a central opening of the cylinder and a backwall that extends over the chambers at an end of the barrel.

One aspect is directed to a handgun that fires ammunition rounds. The handgun includes a body with a trigger, a grip, two upper barrels, and a lower barrel. A firing pin is mounted in the body and movable between a first position and a second position. A cylinder is rotatable relative to the body with the cylinder having chambers that are aligned in an outer group positioned in proximity to a periphery of the cylinder and an inner group positioned in proximity to a center of the cylinder. The cylinder is rotatable relative to the body to indexing positions that each comprise two of the chambers of the outer group being aligned with the two upper barrels and one of the chambers of the lower group being aligned with the lower barrel. The firing pin is movable between the first position to fire rounds from two of the chambers of the outer group and the second position to fire rounds from one of the chambers of the inner group.

The handgun can include that the firing pin is further movable to a third position to extend over two of the chambers of the outer group and one of the chambers of the inner group.

The handgun can include that the firing pin is positioned in a block that is movable within the body with the block being movable to locate the firing pin between the first and second positions.

The handgun can include that the firing pin has a first member that extends over the outer group of chambers and a second member that extends over the inner group of chambers.

The handgun can include that the outer group includes twice as many of the chambers as the inner group.

The handgun can include that the firing pin has first and second sections that are individually movable and in the first position the first section extends over a first one of the chambers of the outer group and being spaced away from the inner group and a second one of the chambers of the outer group.

The handgun can include that the body further includes a first section that is pivotally connected to a second section, the two upper barrels and the lower barrel being positioned with the first section and the firing pin, the grip, and the trigger being positioned with the second section.

The handgun can also include a cap sized to extend over an end of the cylinder and comprising an extension that fits into a central opening of the cylinder and a backwall that extends over the chambers at an end of the barrel.

One aspect is directed to a method of using a handgun. The method includes positioning a switch on a body to a first position. The method includes that while the switch is in the first position, pulling a trigger and indexing a cylinder to a first indexing position and firing through a first upper barrel a round from one of a plurality of outer chambers of a cylinder. The method includes positioning the switch to a second position. The method includes while the switch is in the second position, pulling the trigger and indexing the cylinder to a second indexing position and firing through a lower barrel a round from one of a plurality of inner chambers of the cylinder. The method includes positioning the switch to a third position. The method includes while the switch is in the third position, pulling the trigger and indexing the cylinder to a third indexing position and firing through the first upper barrel a round from one of the plurality of outer chambers of the cylinder and simultaneously firing a round through the lower barrel from one of the inner chambers of the cylinder.

The method can also include that while the switch is in the third position, firing the rounds through the first upper barrel and the lower barrel and simultaneously firing a round through a second upper barrel from one of the plurality of outer chambers of the cylinder.

The method can also include contacting a first section of a firing pin against the round in one of the outer chambers and firing the round through the first upper barrel and contacting a second section of the firing pin against the round in the other one of the outer chambers and firing the round through the second upper barrel.

One aspect is directed to a handgun that fires rounds. The handgun includes a body with a trigger and a grip. A front end is pivotally mounted to the body and includes at least an upper barrel and a lower barrel. The front end also includes an extension pin. A firing pin is mounted in the body and movable between a first position and a second position. A cylinder is removably mounted to the front end and includes an outer group of chambers each sized to hold one of the rounds and an inner group of chambers each sized to hold one of the rounds. The cylinder also includes a central opening that receives the extension pin and is sized to attach to the front end with the extension pin extending into the central opening. The cylinder is rotatable relative to the front end to different indexing positions. Each of the indexing positions includes one of the chambers of the outer group being aligned with the upper barrel and one of the chambers of the inner group being aligned with the lower barrel. The firing pin is movable between the first position to extend over at least one of the chambers of the outer group and the second position to extend over one of the chambers of the inner group.

The outer group can include the same number of chambers as the inner group.

The outer group can include more chambers than the inner group.

The upper barrel can include two separate barrels.

The outer group can include twice as many chambers as the inner grouping.

One aspect is directed to a handgun that fires ammunition rounds. The handgun includes a body with a trigger and a grip. A front end is pivotally mounted to the body and includes two upper barrels and a lower barrel. A firing pin is mounted in the body and movable between a first position and a second position. A cylinder is rotatable relative to the body and includes an outer group of chambers each sized to hold one of the rounds and an inner group of chambers each sized to hold one of the rounds. The cylinder is rotatable relative to the front end and the body to different indexing positions. Each of the indexing positions includes two of the chambers of the outer group being aligned with the two upper barrels and one of the chambers of the lower group being aligned with the lower barrel. The firing pin is movable between the first position to extend over two of the chambers of the outer group and the second position to extend over one of the chambers of the inner group.

The outer group can include twice as many chambers as the inner group.

The various aspects of the various embodiments may be used alone or in any combination, as is desired.

DETAILED DESCRIPTION

Figure 1:
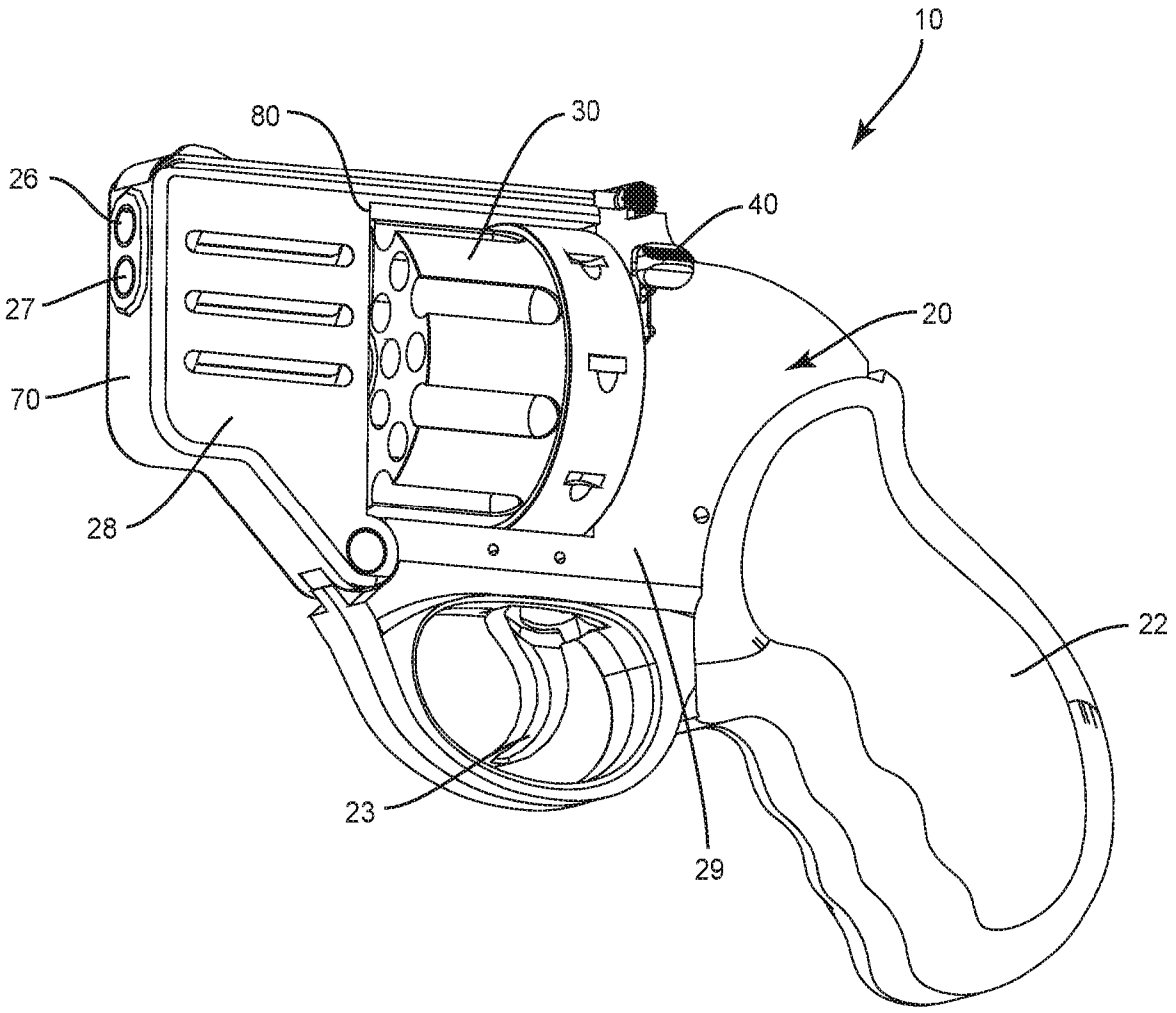
FIG. 1 is a perspective view of a handgun in a closed configuration.
Figure 2:
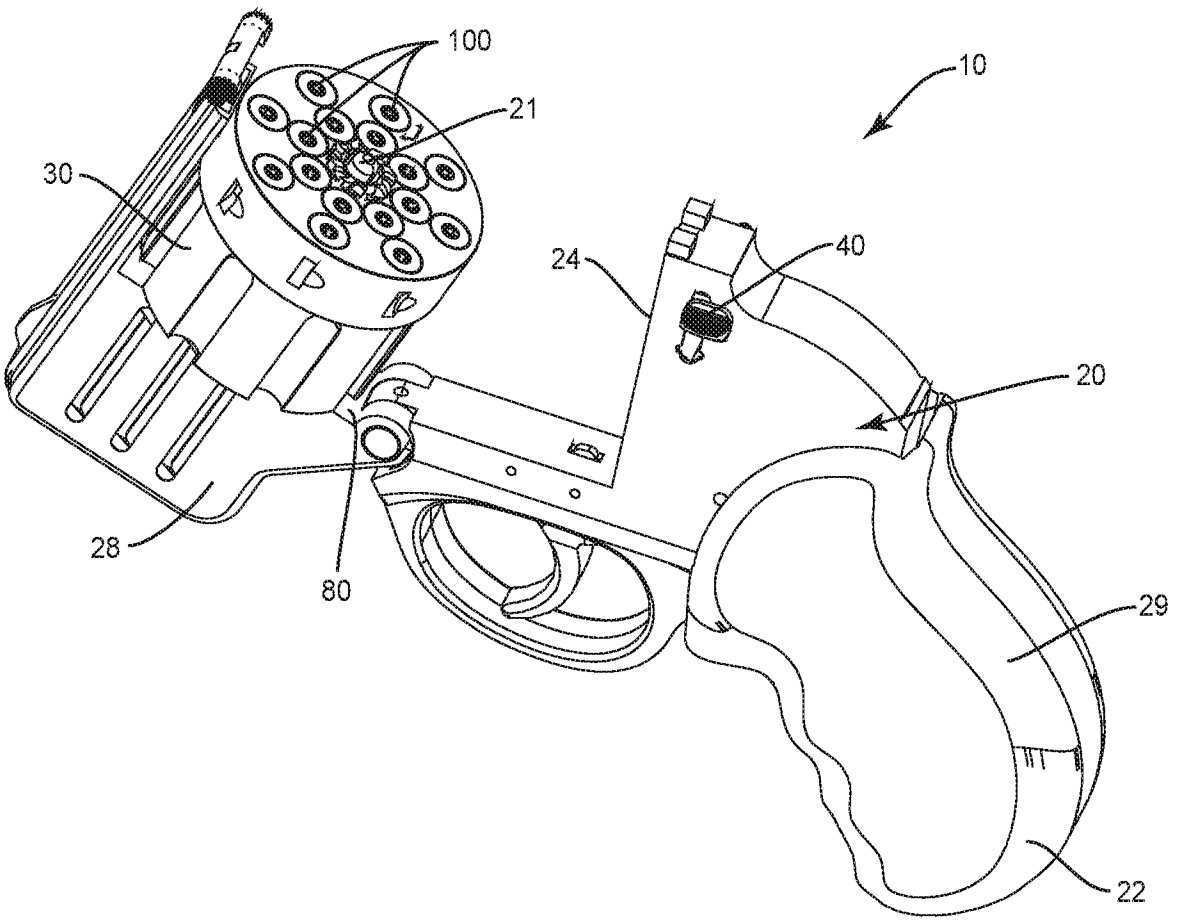
FIG. 2 is a perspective view of the handgun of FIG. 1 in an open configuration.

The present application is directed to a handgun that can be configured to different settings. The setting provide for firing a single round or two or more rounds. The handgun can include a body with two or more barrels. The handgun can also include a cylinder with different chambers positioned into groups that align with the barrels. The handgun includes a switch that can be moved to configure the handgun between the different settings. FIGS. 1 and 2 illustrate a handgun 10 that is movable between a closed position for firing the one or more rounds 100 and an open position for accessing the rounds 100 for loading and unloading. The body 20 includes a first section 28 that is pivotally connected to a second section 29. A cylinder 30 configured to hold the rounds 100 is attached to the first section 28.

The first section 28 includes an upper barrel 26 and a lower barrel 27 each extending through the body 20 between a front end 70 and an inner face 80. An extension 21 extends outward from the inner face 80 and is configured to receive the cylinder 30. The second section 29 includes a grip 22 and a trigger 23. The second section 29 also includes a face 24 that is oriented towards the cylinder 30 when the handgun 10 is in the closed position. The body 20 can be constructed from a variety of different materials, including but not limited to metal and printed polymer.

Figure 3:
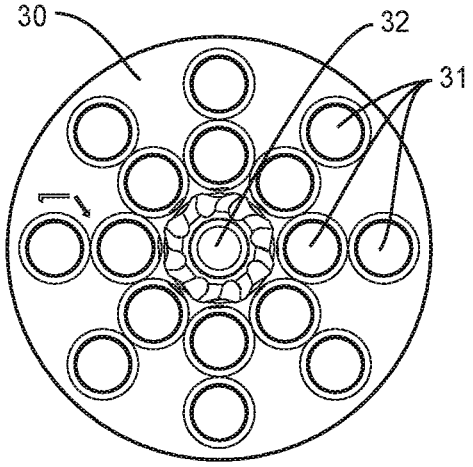
FIG. 3 is an end view of cylinder with rounds positioned in the outer chambers.

As illustrated in FIG. 3, the cylinder 30 includes a central opening 32 that is mounted on the extension 21 that extends outward from the inner face 80 of the first section 28. The central opening 32 is sized to slide onto the extension 21 to remove and replace the cylinder 30 as necessary. The cylinder 30 is rotatable about the extension 21 to different indexing positions. The cylinder 30 includes chambers 31 that are each sized to hold one of the rounds 100. The chambers 31 are arranged in a first inner group adjacent to the central opening 32. These first chambers 31 are positioned to align with the lower barrel 27. A second outer group of chambers 31 is positioned in closer proximity to the outer periphery of the cylinder 30. The outer chambers 31 align with the upper barrel 26. The inner and outer chambers 31 may be the same or different sizes. In one embodiment, the outer chambers 31 are sized to hold .22 WMR (Winchester Magnum Rimfire) rounds and the inner chambers 31 are sized to hold .22 LR (Long Rifle) rounds.

As illustrated in FIG. 3, each of the inner and outer chambers 31 are aligned in pairs along a common radius that extends radially outward from the central opening 32. During indexing of the cylinder 30, each of the pairs aligns with their corresponding barrels 26, 27.

Figure 4:
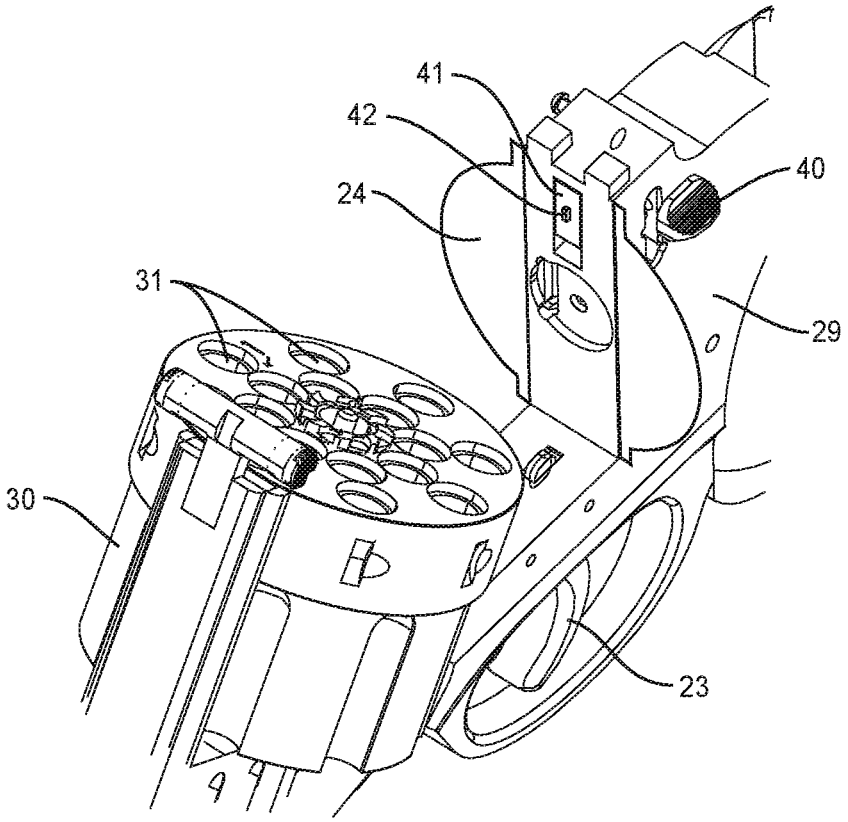
FIG. 4 is a schematic view of a handgun in an open configuration and a firing block and firing pin in a first position.
Figure 5:
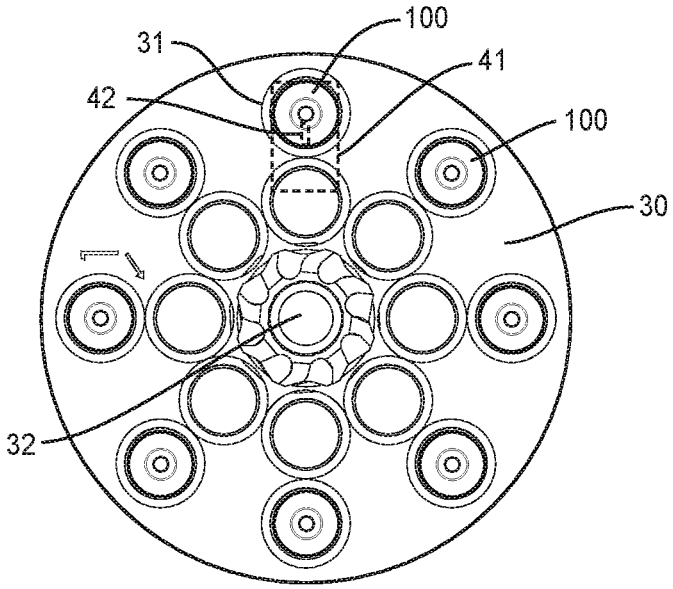
FIG. 5 is an end view of a cylinder and a firing block and a firing pin in dashed lines in a first position.

The switch 40 is movably mounted on the second section 29 of the body 20 to adjust the position of a firing block 41 and one or more firing pins 42. As illustrated in FIG. 4, the block 41 and firing pin 42 are positioned in the face 24 of the second section 29. The switch 40 can move the firing block 41 and one or more firing pins 42 between different positions. FIGS. 4 and 5 illustrate a first position that locates the firing block 41 and firing pin 42 to contact against a round 100 in one of the outer chambers 31. When the firing pin 42 contacts against the round 100, the round 100 is expelled through the upper barrel 26 (which is aligned with the chamber 31).

Figure 6:
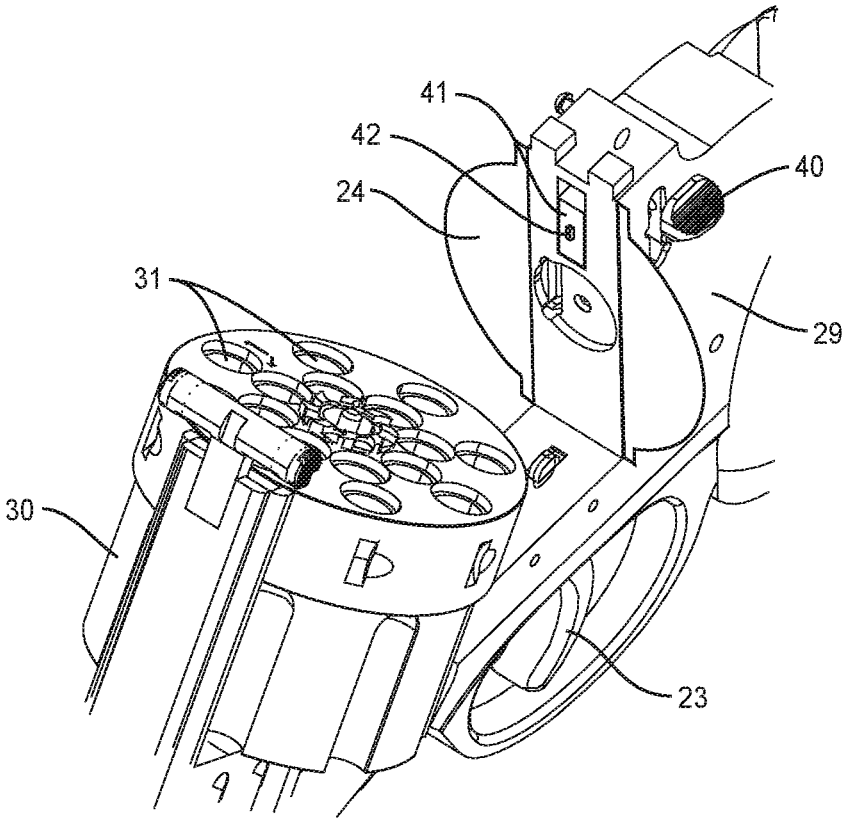
FIG. 6 is a schematic view of a handgun in an open configuration and a firing block and firing pin in a second position.
Figure 7:
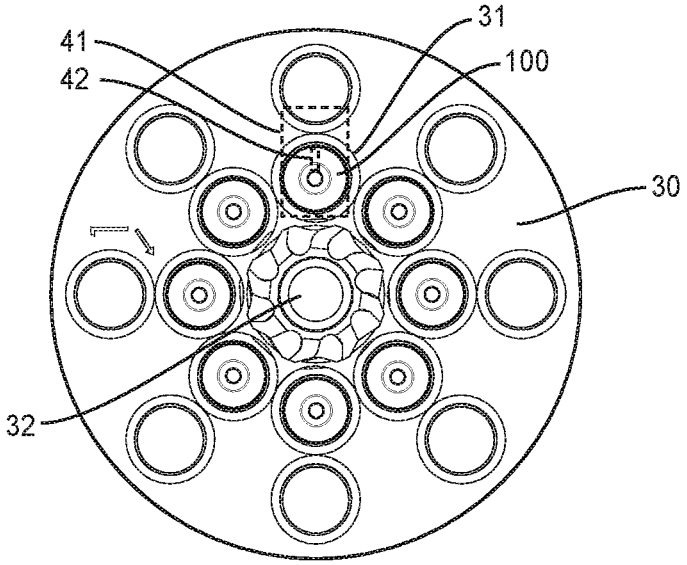
FIG. 7 is an end view of a cylinder and a firing block and a firing pin in dashed lines in a second position.

FIGS. 6 and 7 illustrate a second position with the firing block 41 located for the firing pin 42 to contact against a round 100 in the inner group of chambers 31. When the firing pin 42 makes contact with the round 100, the round 100 is expelled through the lower barrel 27.

In the first and second positions, the firing block 41 and firing pin 42 are configured to contact a round 100 in either the inner or outer group of chambers 31. In a third position, the firing block 41 is positioned for the firing pin 42 to contact against the rounds 100 in both the inner and outer pair of chambers 31. This results in a volley firing configuration in which two rounds 100 are fired simultaneously from the barrels 26, 27.

Figure 8:
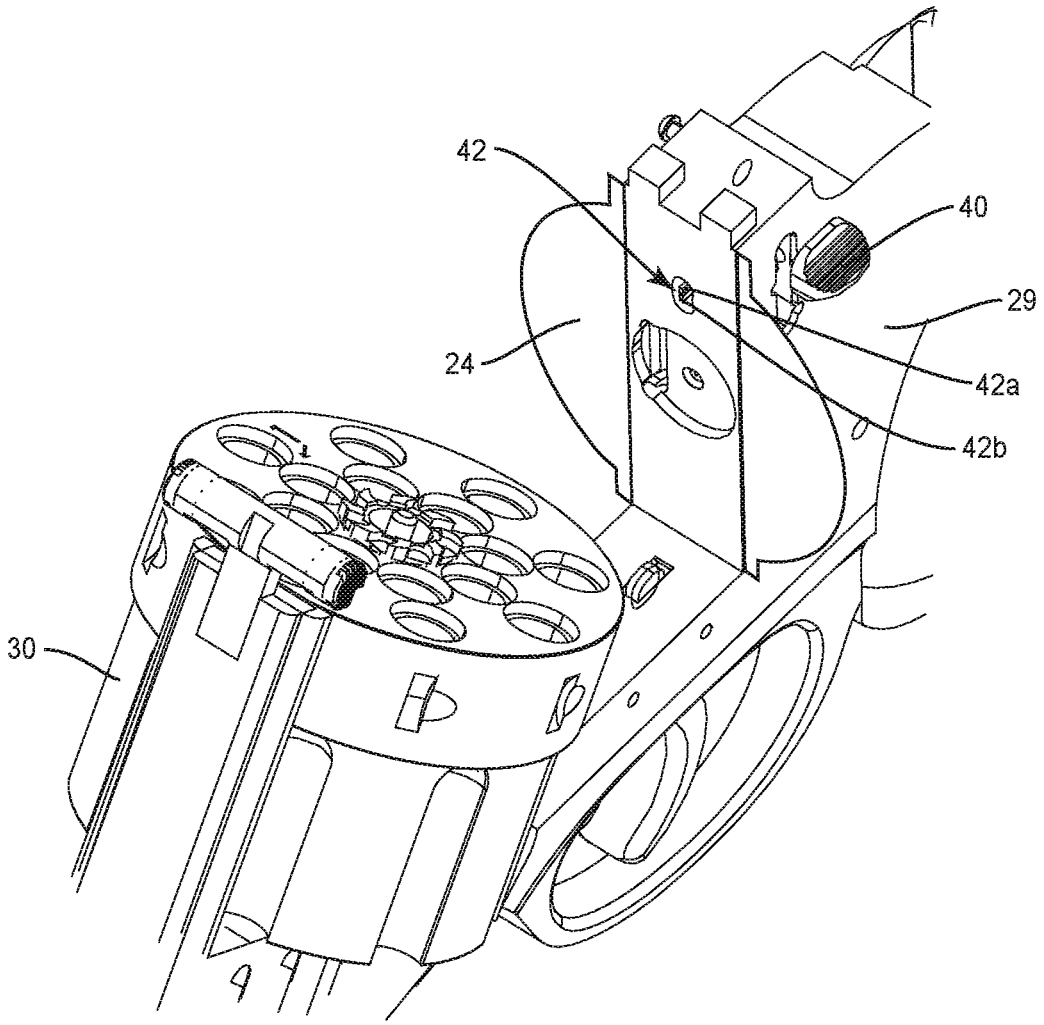
FIG. 8 is a schematic view of a handgun in an open configuration and a firing block and firing pin in a third position.

FIG. 8 illustrates the third position and with a firing pin 42 including first and second pins 42*a*, 42*b*. The firing pin 42 is positioned with the first pin 42*a* positioned to contact against a round 100 in the outer chamber 31 and the second pin 42*b* to contact against a round 100 in the inner chamber 31. The two separate pins 42*a*, 42*b* helps to ensure there is adequate contact with both rounds to make certain they are both fired. In this design, the firing block 41 is recessed inward from the face 24. With the two firing pin design, the pins 42*a*, 42*b* are located in the first and second positions to avoid a volley shot. That is, just one of the pins 42*a* or 42*b* contact against a round 100 in each of the first and second positions.

The firing pin 42 can also include a single piece construction and be positioned in the third position. With a single firing pin 42, the firing pin 42 is sized to extend over and simultaneously contact rounds 100 in the inner and outer chambers 31.

Figure 9:
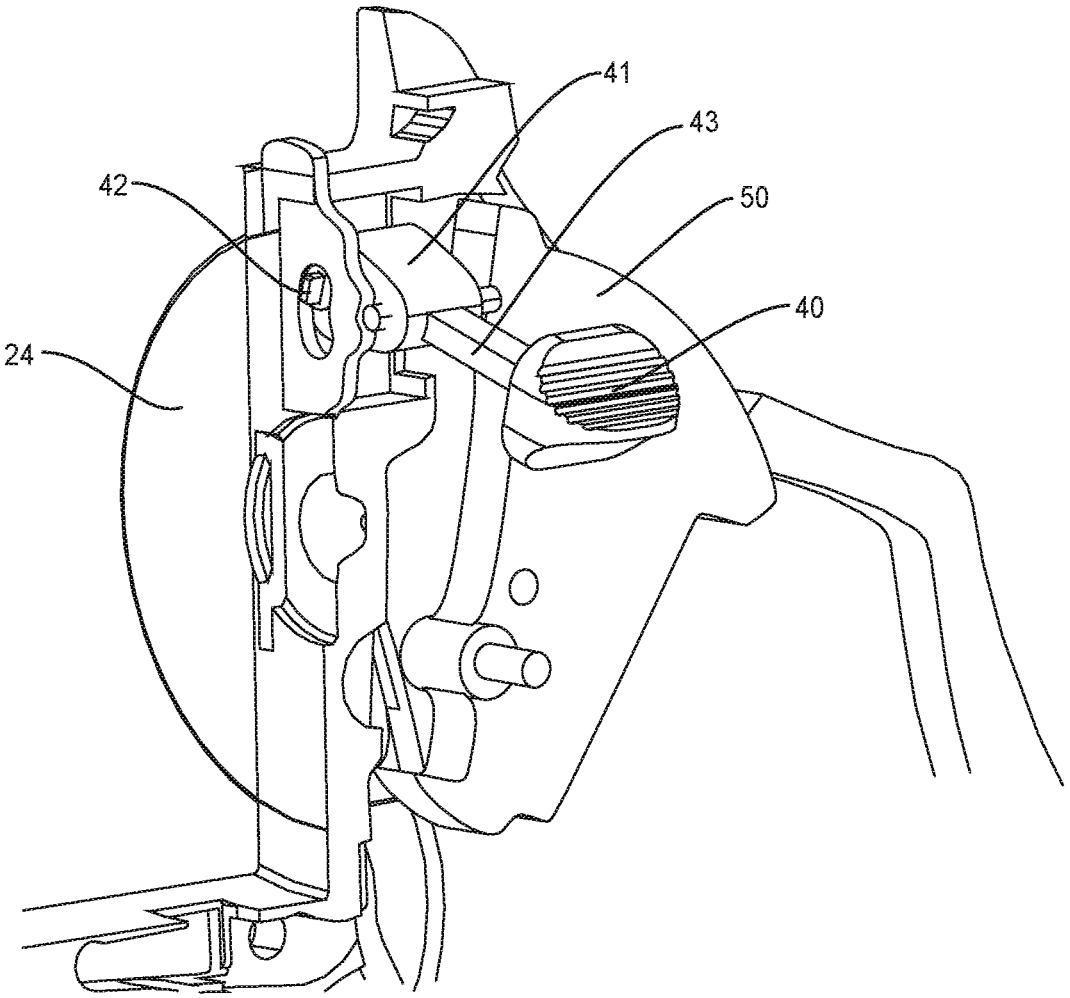
FIG. 9 is a schematic cut-away view of a switch that is connected to a firing block.

FIG. 9 illustrates the switch 40 connected to the firing block 41 through an arm 43. The switch 40 can be moved by the user between the various positions. This movement locates the firing block 41 and firing pin 42 as necessary. A hammer 50 operatively connected to the trigger 23 provides the contact force that contacts the firing pin 42 against the rounds 100 for firing.

Figure 10:
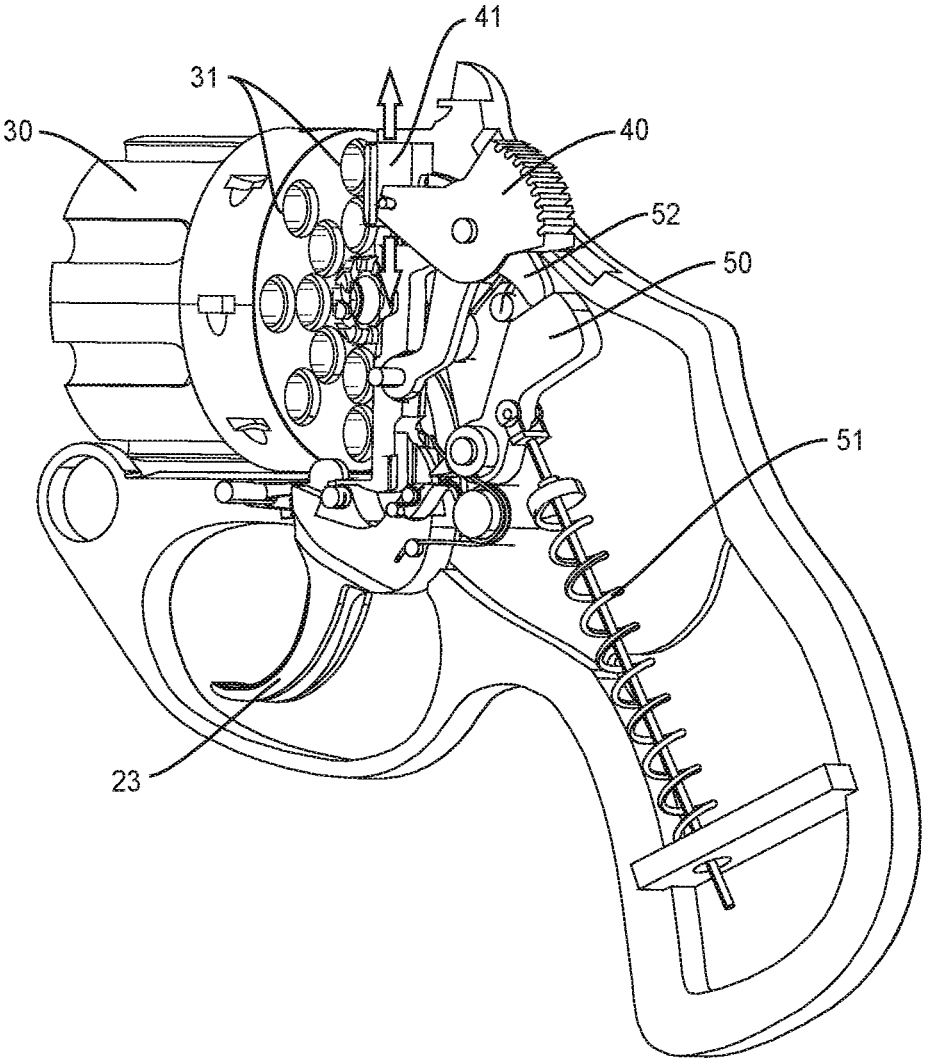
FIG. 10 is a perspective view of firing components positioned relative to a cylinder.

The switch 40 can be located on different positions along the second section 29. FIG. 10 includes the switch 40 located along a top side of the second section 29. The switch 40 is connected to the firing block 41 to adjust the position as necessary. FIG. 10 also illustrates the firing components of the handgun 10. A spring 51 applies a force to a hammer 50 that is transferred to the switch 40 through a transfer bar 52. Pulling the trigger 23 causes the hammer 50 to pivot backward against the spring 51. The hammer 50 is then released applying a contacting force to the transfer bar 52 that reaches the firing pin 42. In addition, pulling the trigger 23 causes rotational indexing of the cylinder 30 to align subsequent chambers 31 and rounds 100.

Figure 11:
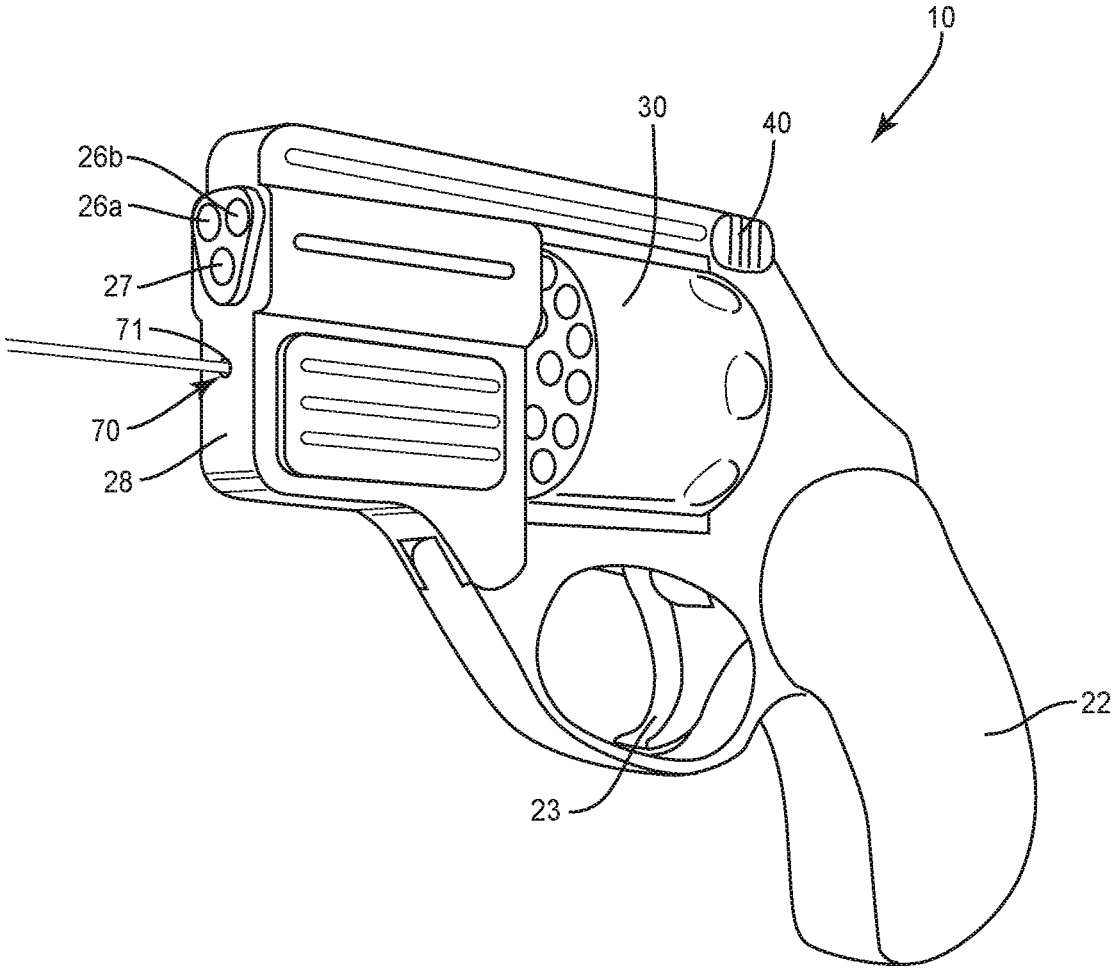
FIG. 11 is a perspective view of a handgun in a closed configuration.
Figure 12:
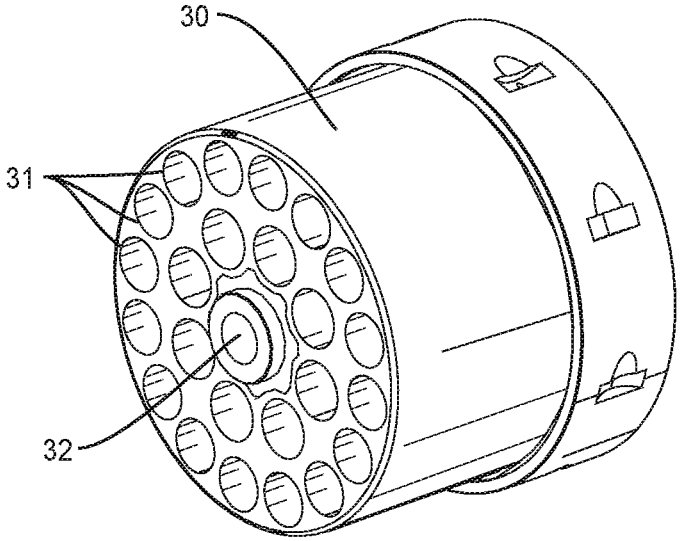
FIG. 12 is a perspective view of a cylinder.

FIG. 11 includes a handgun 10 with a triple barrel design having two upper barrels 26*a*, 26*b* and a single lower barrel 27. The upper barrels 26*a*, 26*b* align with the outer group of chambers 31 on the cylinder 30, and the lower barrel 21 aligns with the chambers 31 of the inner group. FIG. 12 illustrates a cylinder 30 for use with the triple barrel handgun 10. The cylinder 30 includes an outer group with sixteen chambers 31 aligned along the outer periphery. The inner group includes eight chambers 31 that are in closer proximity to the central opening 32. The chambers 31 can include the same or differences sizes, and can be configured to hold the same or different types of rounds 100.

Figure 13:
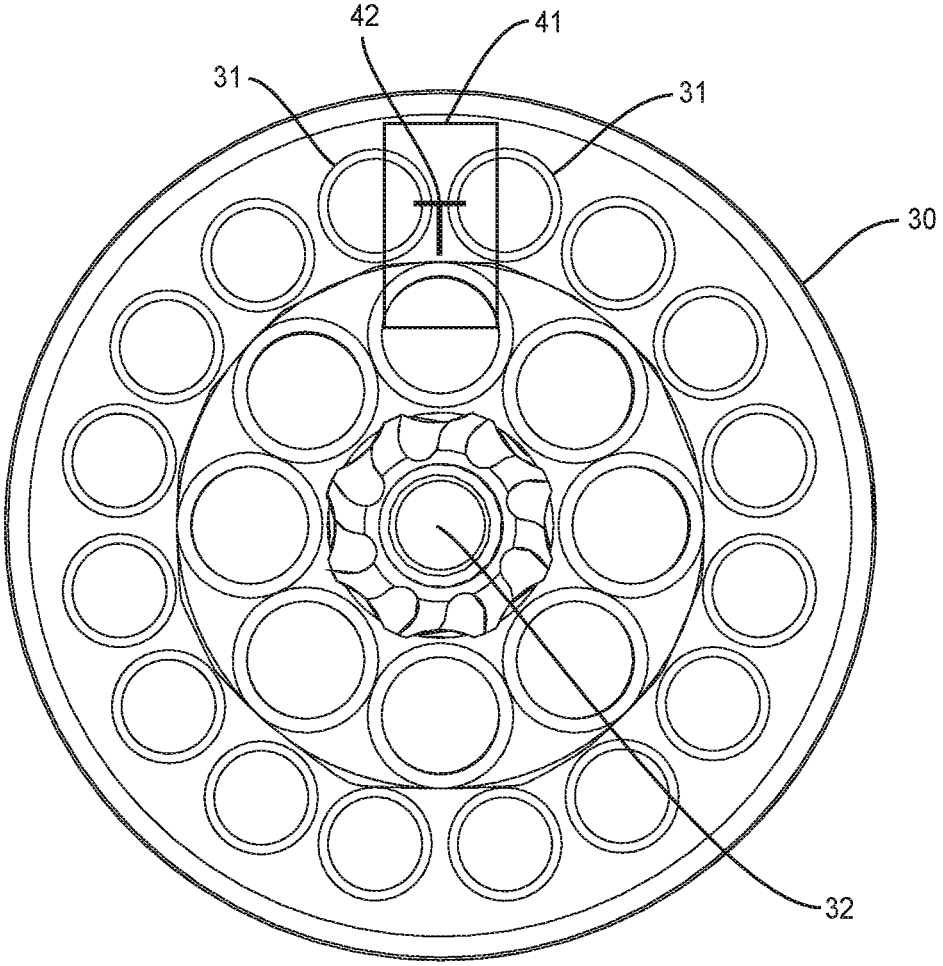
FIG. 13 is an end view of a cylinder and a firing block and a firing pin in in a first position.

As with the double barrel design, the triple barrel handgun 10 includes a switch 40 controls the position of the firing pin 42. In a first position as illustrated in FIG. 13, the firing block 41 locates the firing pin 42 to extend over two of the outer chambers 31. This results in both rounds 100 in the chambers 31 being simultaneously fired from the upper barrels 26*a*, 26*b*. In this design, the firing pin 42 is shaped to extend over multiple chambers 31. This can include a T-shape as illustrated in FIG. 13. Various other shapes can also be used to provide for the two shoot output.

Figure 14:
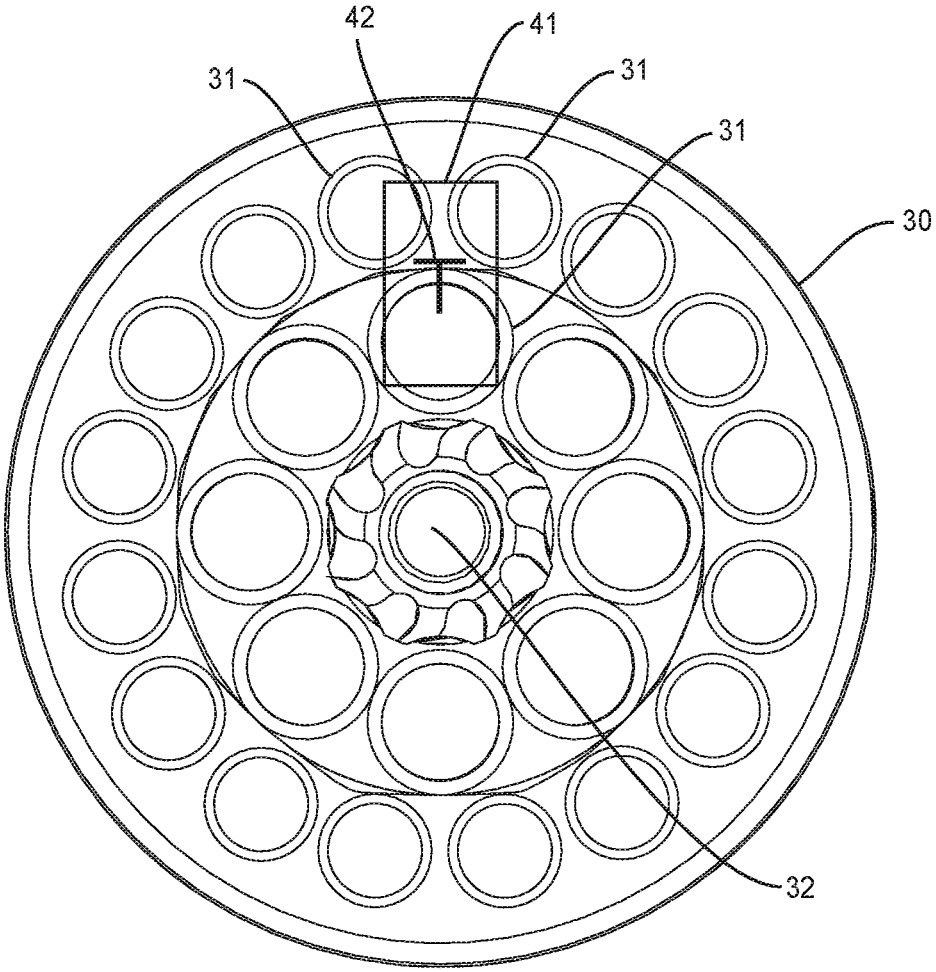
FIG. 14 is an end view of a cylinder and a firing block and a firing pin in in a second position.

In the second position as illustrated in FIG. 14, the firing block 41 is in the second position. This positions the firing pin 42 over a chamber 31 of the second grouping of the inner chambers 31. This results in a single round 100 being fired from the handgun 10 through the lower barrel 27.

Figure 15:
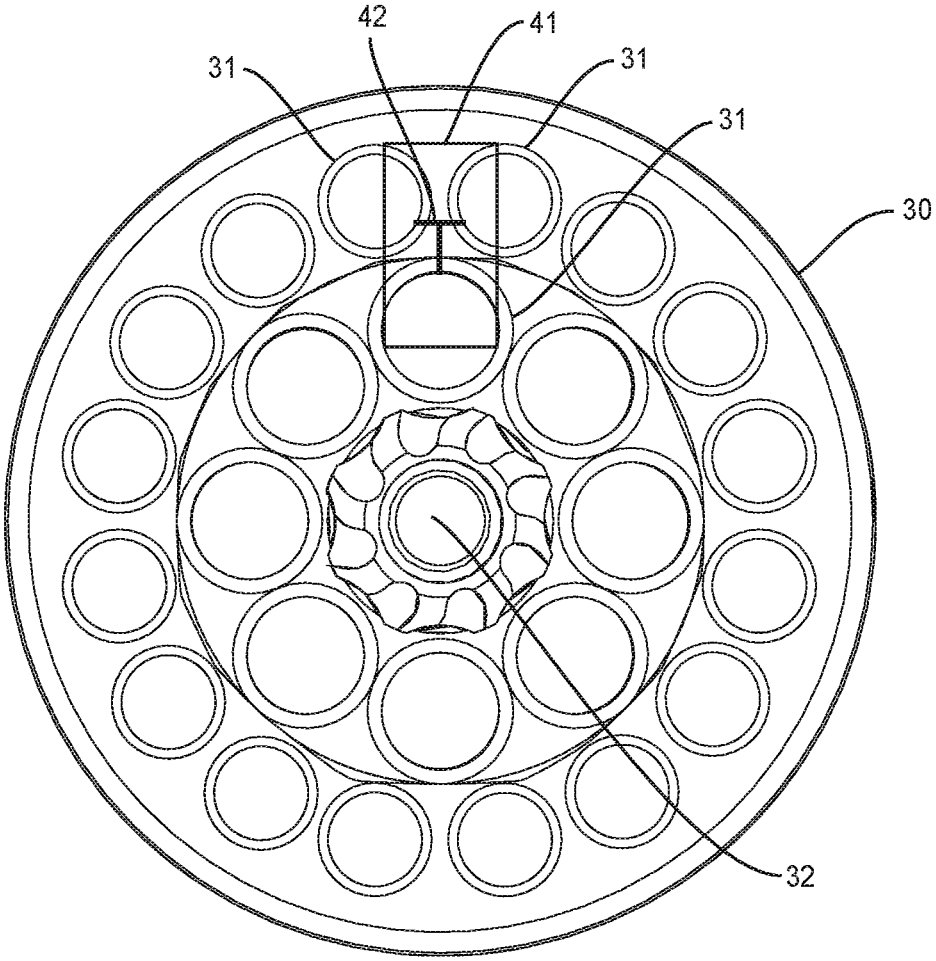
FIG. 15 is an end view of a cylinder and a firing block and a firing pin in in a third position.

The switch 40 can also be in a third position as illustrated in FIG. 15 with the firing pin 42 extending over three different chambers 31. This may include extending over two outer chambers 31 and a single inner chamber 31. This results in three rounds 100 being simultaneously fired through the three barrels 26*a*, 26*b*, 27.

Various types of rounds 100 can be used in the handguns 10. Further, the rounds can include rimfire as well as center fire. Rimfire provides for the firing pin 42 to strike and crush the rim of the round 100 to ignite the primer and fire the round. Centerfire includes the firing pin 42 striking the center of the backend of the round 100 to set off the primer.

During use of the various handguns 10, the cylinder 30 is loaded with rounds 100. The user positions the switch 40 in the desired position depending upon how many rounds 100 are to be fired for each trigger pull. The user than aims the handgun 10 and pulls the trigger 23 thus indexing the cylinder 30 to align a first set of the chambers 31 with the barrels 26, 27. The hammer 50 is pulled backwards against the bias of the spring 51 and is then released. This causes the firing pin 42 to contact against the one or more rounds 100 in the first set of chambers 31.

With the switch 40 in the first position, in a two-barrel design a single round 100 is fired through the upper barrel 26 from one of the outer chambers 31. In a triple barrel design, rounds 100 are fired through each of the upper barrels 26*a*, 26*b* from a pair of outer chambers 31. With the switch 40 in the second position, a single round 100 is fired through the lower barrel 27 in both the two barrel and triple barrel designs. With the switch in the third position, for the two barrel design rounds 100 are fired from outer and inner chambers 31 through the upper and lower barrels 26, 27. For the triple barrel design, a pair of rounds 100 are fired through the upper barrels 26*a*, 26*b* from a pair of the outer chambers 31 and one round 100 is fired through the lower barrel 27 from one of the inner chambers 31.

To continue shooting, the switch 40 is positioned at the desired position. The handgun 10 is again aimed and the user pulls the trigger 23 rotating the cylinder 30 to the next indexing position and repeating the process. The user can continue pulling the trigger 23 and indexing the cylinder 30 to fire each of the rounds 100 in the cylinder 30. In one method, the switch 40 can be positioned in one of the first and second positions. The user can then continually pull the trigger 23 and fire each of the rounds 100 from either the inner or outer chambers 31. The user can then move the switch 40 to the other position. The user can again continually pull the trigger 23 and fire each of the rounds 100 in the remaining chambers.

The handguns 10 can be configured to operate in various different modes. One handgun 10 as described above provides for the switch 40 to select between one of three different modes: just outer rounds; just inner rounds; and simultaneously both inner and outer rounds. Another handgun 10 provides for the switch 40 to select between two different modes: firing just the inner rounds 100; and firing just the outer rounds 100. Another handgun 10 can provide for a single mode of firing that includes simultaneously firing both the inner and outer rounds 100.

Figure 16:
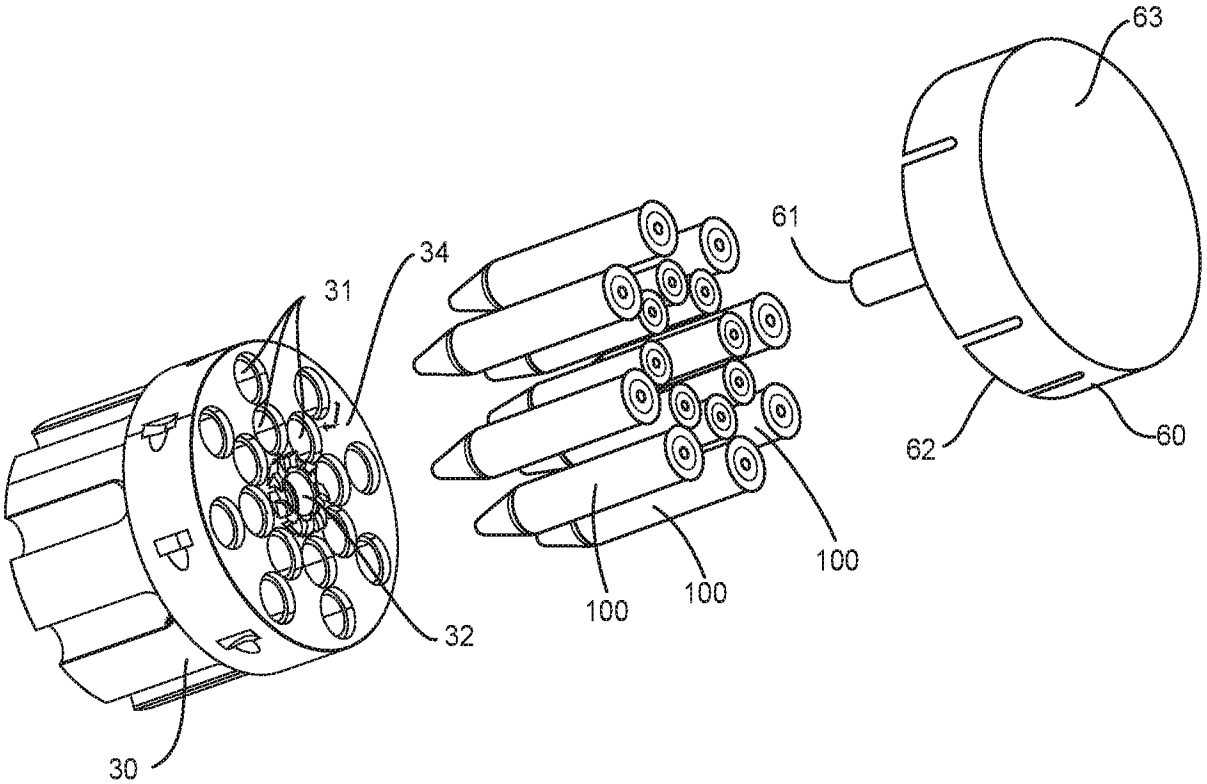
FIG. 16 is an exploded perspective view of a cylinder cap, rounds, and a cylinder.

The handgun 10 may be rapidly re-loaded by using spare cylinders 30. As illustrated in FIG. 16, a cap 60 is sized to fit over the back end 34 of the loaded cylinder 30. This maintains the rounds 100 in the chambers 31, such as during handling of the loaded cylinder 30. The cap 60 includes a circular shape and is sized to fit over the back end 34 of the cylinder 30. Sidewalls 62 on the cap 60 extend over the sides of the cylinder 30 with the back wall 63 extending across the back end 34 of the cylinder 30. An extension 61 extends outward from a center of the back wall 63 and is sized to fit within the central opening 32 of the cylinder 30. The extension 61 is sized to extend over the exposed ends of the rounds 100, and the sidewalls 62 further extend over the lateral sides of the cylinder 30.

During loading, the spare cylinder 30 is inserted onto the extension pin 25. As the cylinder 30 slides along the extension pin 25 and the end of the extension pin 25 contacts against the extension 61. The continued movement of the cylinder 30 along the extension pin 25 causes the extension pin 25 to push the cap 60 away from the end of the cylinder 30. With the cap 60 removed, the handgun 10 can be moved to the closed configuration and is ready for use.

In the various designs, the cylinder 30 can be configured to facilitate its use. As illustrated in FIG. 16, the back end of the cylinder 30 can include a raised ridge 33. The ridge 33 can include a greater diameter to extend outward beyond the lateral sides of the cylinder 30. The ridge 33 can also extend axially outward beyond the back side 34 to protect the rims of the rounds 100 that are seated in the chambers 31. The ridge 33 can also provide a grip for a user when handling the cylinder 30 and provide for an engagement structure for the cap 60. In another design, there is no ridge 33 and the back side 34 abuts with the lateral sides of the cylinder 30.

The handgun 10 can also include a laser feature 70 as illustrated in FIG. 11. The laser feature 70 includes a laser that emits a small, visible light through an opening 71 in the first section 28. The light is emitted to be parallel to the barrels 26*a*, 26*b*, 27. The laser feature 70 includes an activation mechanism that can be located in one of three positions. The first position is achieved by the user placing their finger on the trigger 23 and applying a light pull. The trigger 23 includes a "stop" or a substantially heavier resistance at this first position. This first position activates the laser such that a light is emitted from the opening 71.

The second position includes an intermediate amount of movement (i.e., pull) of the trigger 23 by the user. This second position results in firing the handgun 10. Movement to the second position overcomes the stop at the end of the first position and requires significantly more force through the desired length of the pull of the trigger 23 to fire the handgun 10. The laser remains activated through the second position or the entire trigger pull.

The third position occurs after firing when the trigger 23 is released. This results in the laser being reset and ready for a subsequent shot. In one embodiment, the third position does not cause the laser to be turned off because it merely allows enough travel for the trigger 23 to return and reset the sear yet does not fully release the trigger 23. The laser may turn off when the user completely releases the trigger 23.

The laser feature 70 is integrated within the body 20. The laser feature 70 includes a power source such as button cells (or miniature) batteries, a light-emitting laser, a housing, one or more adjustment screws to adjust the positioning of the laser relative to the body 20, and an electrical switch. The integrated design utilizes the body 20 to contain the various parts of the laser feature 70 and thus offer great flexibility in construction and in manufacturing. For example, the batteries can be located where it's convenient for the packaging of the design either in the grip 22 or underneath the barrels 26, 27 depending on the size and configuration of the body 20.

The laser is mounted directly inline and under the barrels 26, 27 in the first section 28. Because components of the laser feature 70 can be positioned in both the first and second sections 28, 29 of the body 20, the pivot connection can include either a rotating electrical connection or a flexible connecting wire that passes through that pivoting location.

Because the pull of the trigger 23 activates the laser feature 70, there is an internal electrical switch within the body 20 that is actuated when the trigger 23 is pulled through the three positions. When the trigger 23 is fully released, the electrical switch within is likewise released and the laser is deactivated.

In one design, each trigger pull causes metal contacts to brush by one another thus cleaning away any corrosion that could have resulted from the handgun being idle. In this manner, the laser feature 70 is self-cleaning.

The handgun 10 can be configured for use with different types of rounds 100. In one embodiment, the handgun 10 is a .22 caliber handguns. However, the handgun 10 can also include other calibers. In one embodiment, the handgun is configured to provide a first caliber for one of the chamber 31 groupings of the cylinder 30, and a different second caliber within the other chamber 31 grouping.

The above description discloses the concepts within the context of a revolver 10. The present disclosure is also applicable to other types of handguns.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc and are also not intended to be limiting. Like terms refer to like elements throughout the description.

As used herein, the terms "having", "containing", "including", "comprising" and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A handgun comprising:

a body with a trigger and a grip, the body further comprising at least one upper barrel and a lower barrel;

a firing pin mounted in the body and movable between different positions; and a cylinder movably mounted to the body and comprising chambers aligned into an outer group that are positioned in proximity to an outer periphery of the cylinder and an inner group that are positioned radially inward from the outer group, each of the chambers sized to hold one round;

the cylinder is rotatable relative to the body to indexing positions that each comprise at least one of the chambers of the outer group being aligned with the at least one upper barrel and one of the chambers of the inner group being aligned with the lower barrel;

the firing pin is movable between the different positions to be positioned at at least one of the chambers of the inner and outer groups;

wherein the firing pin is movable between a first position at two of the chambers of the outer group and away from the chambers of the inner group, a second position at one of the chambers of the inner group and away from the chambers of the outer group, and a third position at at least one of the chambers of the outer group and one of the chambers of the inner group.

2. The handgun of claim 1, further comprising a block that is positioned in the body and includes the firing pin, the block being movable within the body to adjust a position of the firing pin relative to the cylinder.

3. The handgun of claim 1, wherein the firing pin comprises a first member to fire rounds from the outer group of chambers and a second member to fire rounds from the inner group of chambers.

4. The handgun of claim 1, wherein the inner and outer groups include an unequal number of chambers.

5. The handgun of claim 1, wherein the outer group includes twice as many of the chambers as the inner group.

6. The handgun of claim 1, wherein the body further comprises a first section that is pivotally connected to a second section, the at least one upper barrel and the lower barrel being positioned with the first section and the trigger being positioned with the second section.

7. The handgun of claim 1, further comprising a cap sized to extend over an end of the cylinder and comprising an extension that fits into a central opening of the cylinder and a backwall that extends over the chambers at an end of the barrel.

8. A handgun that fires ammunition rounds, the handgun comprising:

a body comprising a trigger, a grip, two upper barrels, and a lower barrel;

a firing pin mounted in the body and movable between a first position and a second position;

a cylinder rotatable relative to the body, the cylinder comprising chambers that are aligned in an outer group positioned in proximity to a periphery of the cylinder and an inner group positioned in proximity to a center of the cylinder;

the cylinder is rotatable relative to the body to indexing positions that each comprise two of the chambers of the outer group being aligned with the two upper barrels and one of the chambers of the lower group being aligned with the lower barrel;

the firing pin is movable between the first position to fire rounds from two of the chambers of the outer group without firing rounds from the chambers of the inner group and the second position to fire rounds from one of the chambers of the inner group.

9. The handgun of claim 8, wherein the firing pin is further movable to a third position to extend over two of the chambers of the outer group and one of the chambers of the inner group.

10. The handgun of claim 8, wherein the firing pin is positioned in a block that is movable within the body, the block being movable to locate the firing pin between the first and second positions.

11. The handgun of claim 8, wherein the firing pin comprises a first member that extends over the outer group of chambers and a second member that extends over the inner group of chambers.

12. The handgun of claim 8, wherein the outer group includes twice as many of the chambers as the inner group.

13. The handgun of claim 8, wherein the firing pin comprises first and second sections that are individually movable, in the first position the first section extending over a first one of the chambers of the outer group and being spaced away from the inner group and a second one of the chambers of the outer group.

14. The handgun of claim 8, wherein the body further comprises a first section that is pivotally connected to a second section, the two upper barrels and the lower barrel being positioned with the first section and the firing pin, the grip, and the trigger being positioned with the second section.

15. The handgun of claim 8, further comprising a cap sized to extend over an end of the cylinder and comprising an extension that fits into a central opening of the cylinder and a backwall that extends over the chambers at an end of the barrel.

16. A method of using a handgun, the method comprising:

positioning a switch on a body to a first position;

while the switch is in the first position, pulling a trigger and indexing a cylinder to a first indexing position and firing rounds through each of a first upper barrel and a second upper barrel from outer chambers of a cylinder and without firing a round from inner chambers of the cylinder;

positioning the switch to a second position;

while the switch is in the second position, pulling the trigger and indexing the cylinder to a second indexing position and firing through a lower barrel a round from one of the inner chambers of the cylinder;

positioning the switch to a third position;

while the switch is in the third position, pulling the trigger and indexing the cylinder to a third indexing position and firing through each of the first and second upper barrels rounds from the outer chambers of the cylinder and simultaneously firing a round through the lower barrel from one of the inner chambers of the cylinder.

17. The method of claim 16, further comprising contacting a first section of a firing pin against the round in one of the outer chambers and firing the round through the first upper barrel and contacting a second section of the firing pin against the round in the other one of the outer chambers and firing the round through the second upper barrel.

* * * * *